US005117584A

United States Patent [19]

Ottenwälder et al.

[11] Patent Number: 5,117,584

[45] Date of Patent: Jun. 2, 1992

[54] SLEEVE FOR FLOWERPOTS FOR THE LIKE

[75] Inventors: Max Ottenwälder; Karl-Leo Heitlinger, both of Schwäb. Gmünd, Fed. Rep. of Germany

[73] Assignee: Heinrich Kossman, Freiburg, Fed. Rep. of Germany

[21] Appl. No.: 499,813

[22] Filed: Mar. 27, 1990

[51] Int. Cl.[5] ..... B32B 3/04; A01G 9/02

[52] U.S. Cl. ..... 47/72; 229/4.5

[58] Field of Search ..... 229/89, 87.03, 87.07, 229/4.5; 47/72

[56] References Cited

U.S. PATENT DOCUMENTS

| | | | |
|---|---|---|---|
| 1,805,212 | 5/1931 | Gaffenberger | 229/4.5 X |
| 2,641,402 | 6/1953 | Bruun | 229/4.5 |
| 3,962,503 | 6/1976 | Crawford | 47/72 X |
| 4,835,834 | 6/1929 | Weder | 47/72 X |

FOREIGN PATENT DOCUMENTS

| | | | |
|---|---|---|---|
| 513971 | 11/1930 | Fed. Rep. of Germany | 47/72 |
| 2619698 | 3/1989 | France | 47/72 |

*Primary Examiner*—David A. Scherbel
*Assistant Examiner*—Joanne C. Downs
*Attorney, Agent, or Firm*—Antonelli, Terry Stout & Kraus

[57] ABSTRACT

A sleeve for flowerpots which is folded in zig-zag manner along convex outer and convex inner fold lines at least over a major part of a height thereof. Concave connecting fold lines are provided at a distance from a marginal edge, with the concave connecting fold lines connecting adjacent outer and inner main fold lines. Between the connecting fold lines and the marginal edge, the arrangement and folding direction of fold lines continuing the main fold lines are interchanged as compared with the main fold lines of the sleeve material.

7 Claims, 2 Drawing Sheets

SLEEVE FOR FLOWERPOTS FOR THE LIKE

FIELD OF THE INVENTION

The invention relates to a sleeve for flowerpots comprising a closed strip of flat material folded in zig-zag manner along convex outer and inner fold lines at least over a major part of a height thereof.

BACKGROUND OF THE INVENTION

Flowerpot covers or overpots are known for protecting plant and flowerpots. However, these covers are relatively expensive and voluminous, which makes storage and handling more difficult. In addition, they are only suitable for certain pot sizes, so that a large number of different flowerpot covers must be kept for different pots. In addition a flowerpot sleeve or tube made from folded strip paper is known. However, it suffers from disadvantageous handling and can easily be pressed in or compressed, which gives the user a feeling of uncertainty with the fear that the flowerpot could slip out of the sleeve.

SUMMARY OF THE INVENTION

The aim underlying invention essentially resides in providing an inexpensive envelope for a plant or flowerpot in the form of a sleeve, which is suitable for several pot sizes, has an adequate natural stability and avoids the disadvantages encountered in the prior art.

According to the invention, a sleeve of the aforementioned type is proposed wherein, at a distance from one marginal edge, concave connecting fold lines are provided with each connecting adjacent outer and inner main fold lines, and wherein, between the connecting fold lines and the marginal edge the arrangement and folding direction of the fold lines continuing the main fold lines are interchanged with respect to the main fold lines of the sleeve material. The inventive construction of a sleeve leads to an almost cylindrical, slightly conical envelope with a zig-zag folding of the outer wall and a sleeve projecting outwards from the main jacket part and forming an upper border. This leads to an increased natural stability, which is particularly advantageous when handling the flowerpot cover sleeve.

In a preferred manner, the sleeve is provided with a base, preferably a tray-shaped base, connected in punctiform manner thereto. This creates a flowerpot cover with a flexible upper border, which can be adapted to different pot sizes, because the upper border remains flexible and can engage on the circumference of the flowerpot located in the thus formed cover. Thus, several flowerpot sizes can be covered by a single sleeve.

According to a preferred development the connecting line passes away from the marginal edge at an angle $\neq 90°$, particularly an angle $<45°$ to the convex main fold lines or the connecting fold lines slope away from the marginal edge as from the outer convex main fold line of the main area of the flat material. As a result of the choice of the orientation of the connecting fold lines and the angle thereof relative to the main fold lines, it is possible to adjust the slope of the collar relative to the main part of the sleeve. While the inventive sleeve can be fundamentally made from paper, according to a preferred development it is made from plastic with prefabricated desired fold lines. According to a further development, the desired fold lines are constructed as film hinge-like weakening lines.

The sleeves of the present invention can be stacked in one another.

Further advantages and features of the invention can be gathered from the claims and the following description, which describes an embodiment of the invention in connection with the accompanying drawings.

DETAILED DESCRIPTION

Figure 1:
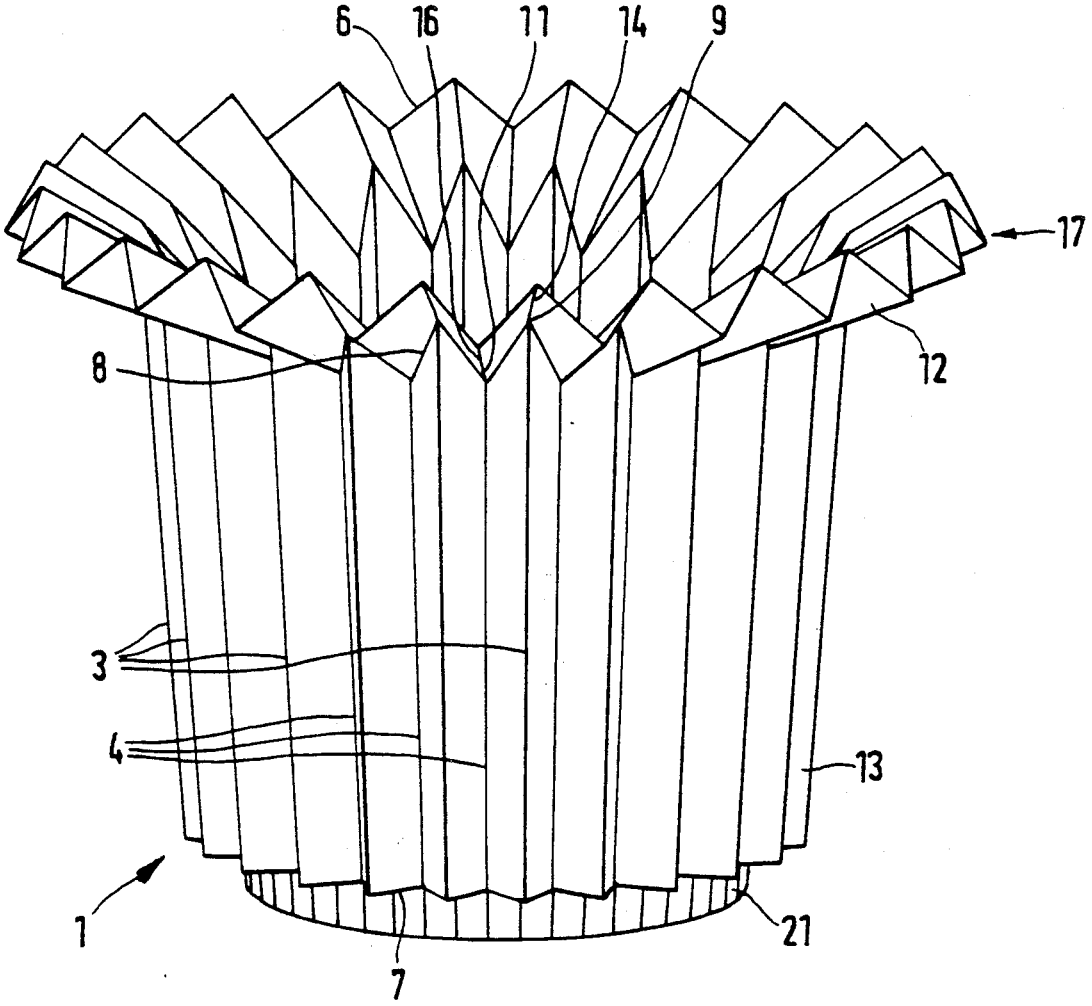
FIG. 1 a perspective view of the inventive sleeve.
Figure 2:
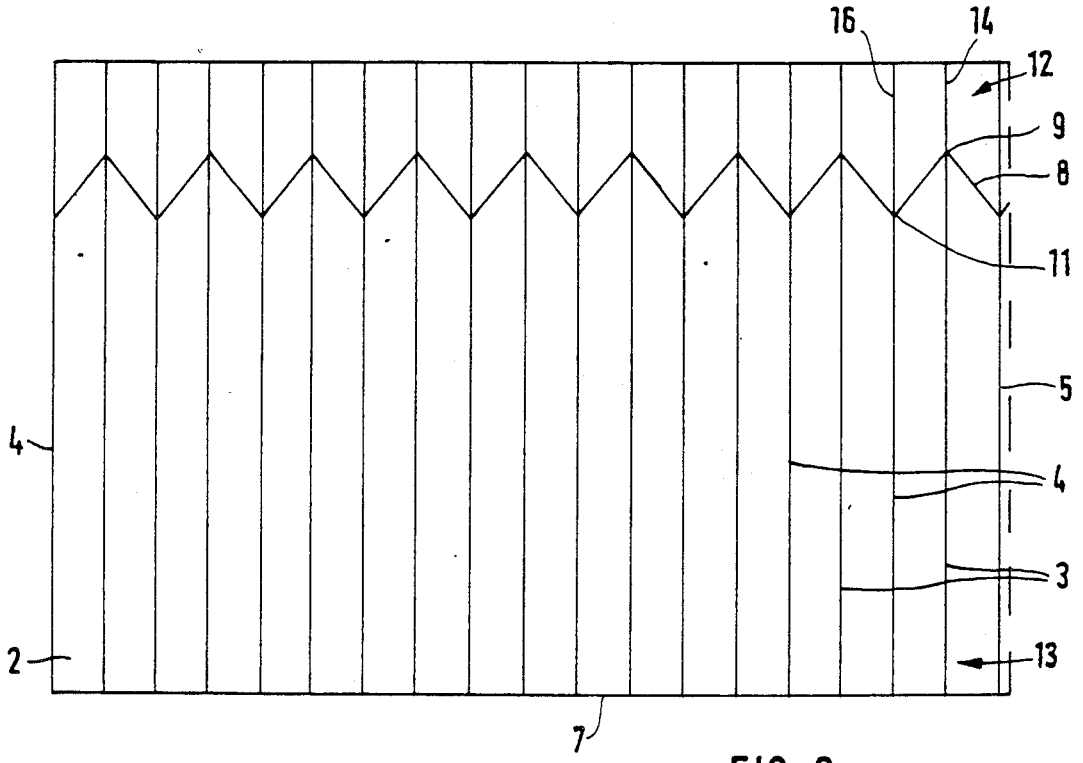
FIG. 2 a projection of the sleeve in one plane.

As shown in the drawings, the inventive flowerpot sleeve 1 comprises a continuous strip 2 of flat material folded in zig-zag manner. The continuous strips 2 can be produced by circular moulding or shaping, e.g. by injection moulding, blow moulding, etc., or can also be produced by joining end faces 4,5 parallel to the fold lines 3. Within the sense of the invention the term continuous strip means a closed strip. The flat material 2 has main fold lines 3,4 perpendicular to the upper and lower marginal areas 6,7, with the main fold lines 3 being convex outer fold lines and the main fold lines 4 concave inner fold lines. Close to, but spaced from a marginal edge 6 are provided further connecting fold lines 8, which in each case connect adjacent outer and inner main fold lines 3,4. All the connecting fold lines 8 are inner concave fold lines. At the intersections 9,11 of main fold lines 3,4 and connecting fold lines 8, the arrangement and folding direction of the main fold lines 3,4 changes towards the marginal area 12. The main fold line 3 in the main area 13 of flat material 2 on the other side of the intersection 9 in marginal area 12 and towards the marginal edge 6 becomes a concave fold line 14 in the viewing direction of FIG. 2 or when the sleeve is completed on considering from the outside and below and said concave fold line 14 (FIG. 1) is higher than the convex fold line 16 (FIG. 2) continuing in marginal area 12 at the intersection 11 of the inner concave fold line 4. As a result of this construction the marginal area 12 (FIG. 2) in the finished flowerpot sleeve becomes a collar 17 bent outwards from the marginal area 13 thereof and projecting over the same. Collar 17 is able to collect pouring or watering water and also gives the sleeve a certain stability.

This is assisted by a base 21 which can be connected to the lower marginal area 7 of sleeve 1 and which, in particular, as shown, can have a tray-like construction and therefore can be placed under the flowerpot so as to collect the watering water. The base 21 need only be connected at a number of individual points to the sleeve, e.g. by welding or in pushbutton-like manner.

We claim:

1. Sleeve for flowerpots comprising a sleeve of plastic material folded in a substantially uniform zig-zag manner along prefabricated convex outer main fold lines and concave inner main fold lines extending substantially perpendicular to an upper marginal area and lower marginal area of the sleeve, prefabricated concave connecting fold lines spaced from the upper marginal area for connecting adjacent convex outer and concave inner main fold lines, and a base fashioned as a tray and fixed to the lower marginal area of the sleeve, wherein an arrangement and folding direction of the convex outer and concave inner fold lines are changed at intersections of the respective concave connecting fold lines with respective convex outer main fold lines and concave inner main fold lines such that the outer main convex fold line becomes a concave fold line and the inner main concave fold line becomes a convex fold line so as to form a collar having a substantially uniform zig-zag configuration around an upper end of the sleeve, and wherein said connecting fold lines slope away from the outer marginal areas, as viewed from the outer convex main fold line.

2. Sleeve according to claim 1, wherein the respective connecting fold lines extend away from the upper marginal area at an angle of less than 90°, particularly an angle $<45°$ with respect to the convex outer fold lines.

3. Sleeve according to claim 2, wherein the angle of the respective connecting lines is less than 45°.

4. Sleeve according to claim 1, wherein all of said fold lines are constructed as film hinge-like weakening lines.

5. Sleeve according to claim 1, wherein said base means is connected at several points to the sleeve.

6. Sleeve according to claim 5, wherein said base means is spot welded to the sleeve.

7. Sleeve according to claim 5, wherein the base means is connected to the sleeve by projections projecting through openings and engaging behind the same.

* * * * *

UNITED STATES PATENT AND TRADEMARK OFFICE

CERTIFICATE OF CORRECTION

PATENT NO. : 5,117,584

DATED : June 2, 1992

INVENTOR(S) : Ottenwälder et al.

It is certified that error appears in the above-identified patent and that said Letters Patent is hereby corrected as shown below:

On title page, item

[73] Assignee: Heinrich Kossmann AG Plasticfabrikation
Freiburg, Fed. Rep. of Germany Signed and Sealed this Eighteenth Day of October, 1994

Bruce Lehman

*Attest:*

BRUCE LEHMAN

*Attesting Officer*

*Commissioner of Patents and Trademarks*